US008452466B2

(12) United States Patent
Kiss et al.

(10) Patent No.: US 8,452,466 B2
(45) Date of Patent: May 28, 2013

(54) METHODS AND SYSTEM FOR DETECTING RAILWAY VACANCY

(75) Inventors: James Kiss, Melbourne, FL (US); John McElroy, Merritt Island, FL (US); Charles Terra, Sebastian, FL (US)

(73) Assignee: General Electric Company, Schenectady, NY (US)

( * ) Notice: Subject to any disclaimer, the term of this patent is extended or adjusted under 35 U.S.C. 154(b) by 1181 days.

(21) Appl. No.: 12/116,792

(22) Filed: May 7, 2008

(65) Prior Publication Data

US 2009/0277998 A1 Nov. 12, 2009

(51) Int. Cl.
*G05D 1/00* (2006.01)
*B61L 21/00* (2006.01)

(52) U.S. Cl.
USPC ..... 701/19; 246/20

(58) Field of Classification Search
USPC ..... 246/20, 21, 27, 28 R, 33, 108, 122 R, 246/123, 177; 701/19, 20; 340/933–943, 340/988, 993; 377/9
See application file for complete search history.

(56) References Cited

U.S. PATENT DOCUMENTS

| | | | | |
|---|---|---|---|---|
| 4,361,300 | A | 11/1982 | Rush | |
| 4,361,301 | A | 11/1982 | Rush | |
| 4,735,383 | A | 4/1988 | Corrie | |
| 5,006,847 | A | 4/1991 | Rush et al. | |
| 5,554,982 | A * | 9/1996 | Shirkey et al. | 340/903 |
| 5,740,046 | A | 4/1998 | Elestedt | |
| 6,533,224 | B1 | 3/2003 | Ireland | |
| 6,666,411 | B1 | 12/2003 | Hart et al. | |
| 7,200,470 | B2 * | 4/2007 | Oguma et al. | 701/19 |
| 7,392,117 | B1 * | 6/2008 | Bilodeau et al. | 701/19 |
| 2006/0249631 | A1 | 11/2006 | Vehar et al. | |
| 2007/0219680 | A1 | 9/2007 | Kumar et al. | |
| 2007/0219681 | A1 | 9/2007 | Kumar et al. | |
| 2007/0219682 | A1 | 9/2007 | Kumar et al. | |
| 2007/0219683 | A1 | 9/2007 | Daum et al. | |
| 2007/0225878 | A1 | 9/2007 | Kumar et al. | |
| 2007/0233335 | A1 | 10/2007 | Kumar et al. | |
| 2007/0233364 | A1 | 10/2007 | Kumar | |
| 2008/0033605 | A1 | 2/2008 | Daum et al. | |

* cited by examiner

*Primary Examiner* — R. J. McCarry, Jr.
(74) *Attorney, Agent, or Firm* — General Electric Company; John A. Kramer

(57) ABSTRACT

A method for detecting railway vacancy is provided. The method includes sensing, at a remote sensing unit positioned proximate to a railway, a presence of a railcar traversing the railway. The method also includes storing, in real-time, at the remote sensing unit, a sensing event indicative of the sensed presence of the railcar traversing the railway and transmitting, asynchronously from the time at which the presence of the railcar was sensed at the remote sensing unit, the stored sensing event to a master accumulation unit.

33 Claims, 4 Drawing Sheets

METHODS AND SYSTEM FOR DETECTING RAILWAY VACANCY

BACKGROUND OF THE INVENTION

The field of this disclosure relates generally to railways and, more particularly, to methods and systems for detecting railway vacancy.

It is often desirable to designate a given railway segment as being either occupied or vacant to enable a determination to be made as to whether a railcar can enter that particular railway segment. To render a vacancy determination as to a particular railway segment, many known vacancy detection systems use sensing devices that, after detecting a railcar, report the presence of the railcar to a single point accumulation device. Known accumulation devices evaluate the sensing events as they occur to enable a continuous, real-time determination as to the vacancy of the entire railway segment to be performed.

Communication between a sensing device and an accumulation device may be susceptible to interruption, such as, for example, from power failures, signal grounding, and/or electromechanical interference at the sensing device. As such, at least some known vacancy detection systems that rely on continuous, real-time communication between each of the sensing devices and the accumulation device may be susceptible to either an inability to render a designation and/or a possibility of rendering an erroneous designation regarding the status of the railway segment because the detection system cannot reconcile sensing events that may have occurred at one or more sensing devices during the communication interruption(s).

Accordingly, it would be desirable to have a detection system that can reconcile a count of railcars present on the railway after an interruption in communication between the accumulation device and one or more sensing devices.

BRIEF DESCRIPTION OF THE INVENTION

In one aspect, a method for detecting railway vacancy is provided. The method includes sensing, at a remote sensing unit positioned proximate to a railway, a presence of a railcar traversing the railway. The method also includes storing, in real-time, at the remote sensing unit, a sensing event indicative of the sensed presence of the railcar traversing the railway and transmitting, asynchronously from the time at which the presence of the railcar was sensed at the remote sensing unit, the stored sensing event to a master accumulation unit.

In another aspect, a system for detecting designated vehicle pathway vacancy is provided. The system includes a master accumulation unit and a remote sensing unit in communication with the master accumulation unit. The remote sensing unit is positioned proximate to a pathway, and the remote sensing unit is configured to sense a presence of a vehicle traversing the pathway. The remote sensing unit is also configured to store, in real-time, at the remote sensing unit, a sensing event indicative of a sensed presence of a vehicle traversing the pathway and to transmit, asynchronously from the time at which the presence of the vehicle was sensed, the stored sensing event to the master accumulation unit.

In another aspect, a method for detecting railway vacancy is provided. The method includes receiving, at a master accumulation unit asynchronously from a time at which a presence of a railcar was sensed by a remote sensing unit, a sensing event indicative of the sensed presence of the railcar traversing the railway and rendering a designation as to a vacant or occupied state of the railway.

DETAILED DESCRIPTION OF THE INVENTION

The following detailed description illustrates exemplary methods and systems for detecting railway vacancy by way of example and not by way of limitation. The description should clearly enable one of ordinary skill in the art to make and use the disclosure, and the description describes several embodiments, adaptations, variations, alternatives, and uses of the disclosure, including what is presently believed to be the best mode of carrying out the disclosure. The disclosure is described herein as being applied to a preferred embodiment, namely, methods and systems for detecting railway vacancy. However, it is contemplated that this disclosure has general application to detecting a presence of any designated vehicle (e.g., an automobile, a marine vessel, etc.) along any pathway and may be applicable in a broad range of transportation systems and/or a variety of other commercial, industrial, and/or consumer applications.

Figure 1:
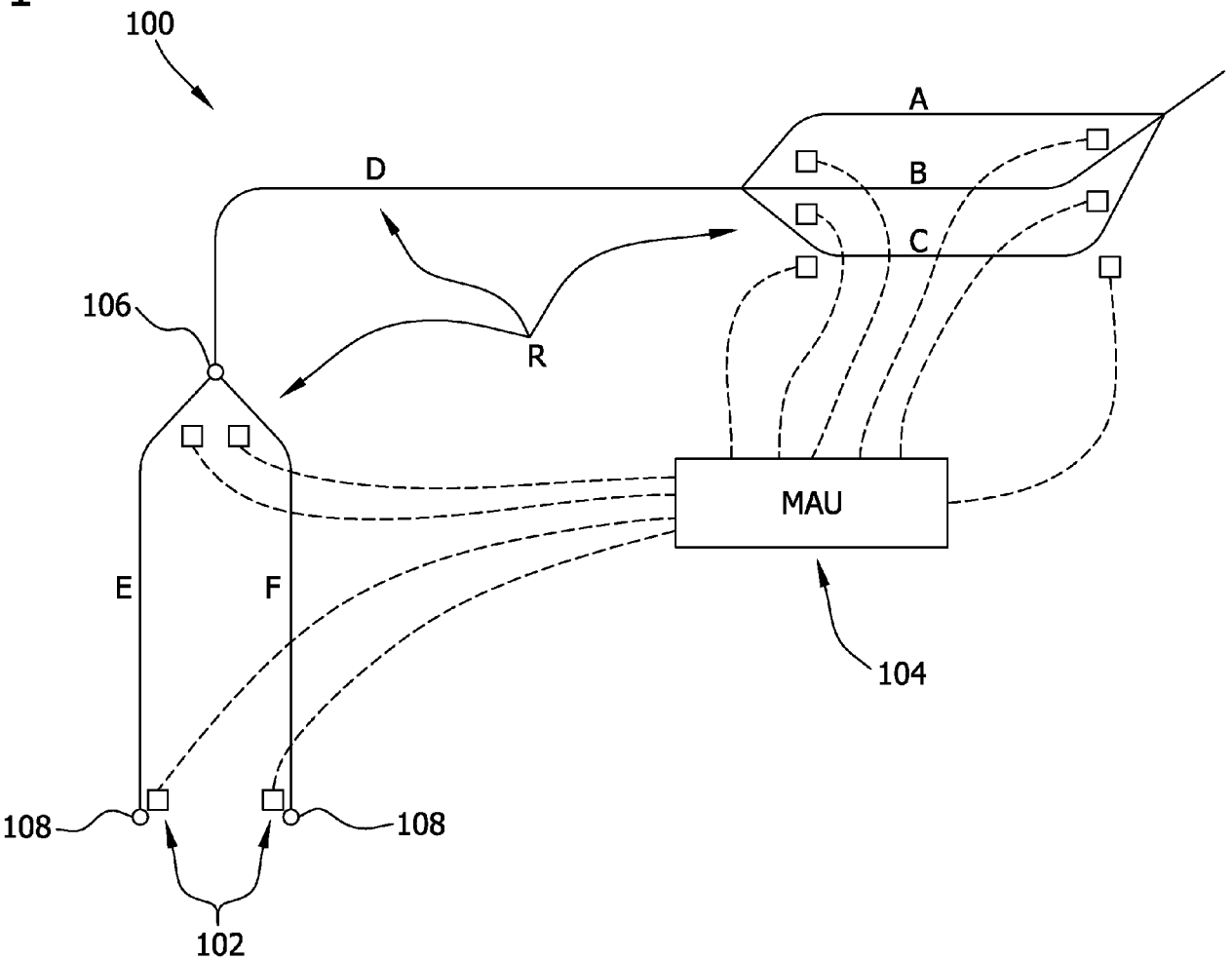
FIG. 1 is a schematic view of an exemplary system that includes a Master Accumulation Unit (MAU) for use in detecting railway vacancy.

FIG. 1 is a schematic view of an exemplary system 100 for use in detecting railway vacancy. In the exemplary embodiment, system 100 detects and monitors a presence of a railcar (not shown) within predefined zones (A, B, C, D, E, and F) of a railway R. System 100, in the exemplary embodiment, includes a Remote Sensing Unit (RSU) 102 that is positioned at either an entry and/or an exit point 106 and 108, respectively, of each railway zone (A, B, C, D, E, and/or F). Moreover, in the exemplary embodiment, system 100 also includes a Master Accumulation Unit (MAU) 104 that is coupled in communication with each RSU 102 to identify a presence of a railcar in each railway zone (A, B, C, D, E, and/or F). In the exemplary embodiment, railway R is a rail yard that enables the storing, sorting, loading and/or unloading of railcars. Alternatively, railway R may be any segment of rail that is traversed by a railcar.

In the exemplary embodiment, MAU 104 is implemented as a part of a computer system (not shown). The computer system, or any component thereof, may be housed within an enclosure that is proximate to railway R, and/or that is located remotely from railway R. The computer system may include a computer, an input device, a display unit, and an interface, for example, to access the Internet. The computer system may also include a processor, which may be connected to a communication bus. The computer may include a memory, which may include a Random Access Memory (RAM) and a Read Only Memory (ROM), as well as a storage device, which may be a hard disk drive or a removable storage drive such as a floppy disk drive, an optical disk drive, and so forth. The storage device is configured to load computer programs and/or other instructions into the computer system. As used herein, the term "processor" is not limited to only integrated circuits referred to in the art as a processor, but broadly refers to a computer, a microcontroller, a microcomputer, microprocessor, a programmable logic controller, an application specific integrated circuit and any other programmable circuit.

The computer system executes instructions, stored in one or more storage elements, to process input data. The storage elements may also hold data or other information, as desired or required, and may be in the form of an information source or a physical memory element in the processing machine. The set of instructions may include various commands that instruct the computer system to perform specific operations, such as the processes of a method. The set of instructions may be in the form of a software program. The software may be in various forms, such as system software or application software. Further, the software may be in the form of a collection of separate programs, a program module within a larger program, or a portion of a program module. The software may also include modular programming in the form of object-oriented programming. The processing of input data by the processing machine may be in response to user commands, to results of previous processing, or to a request made by another processing machine.

As used herein, the term 'software' includes any computer program that is stored in the memory, to be executed by a computer, which includes RAM memory, ROM memory, EPROM memory, EEPROM memory, and non-volatile RAM (NVRAM) memory. The memory types mentioned above are only exemplary and do not limit the types of memory used to store computer programs.

Figure 2:
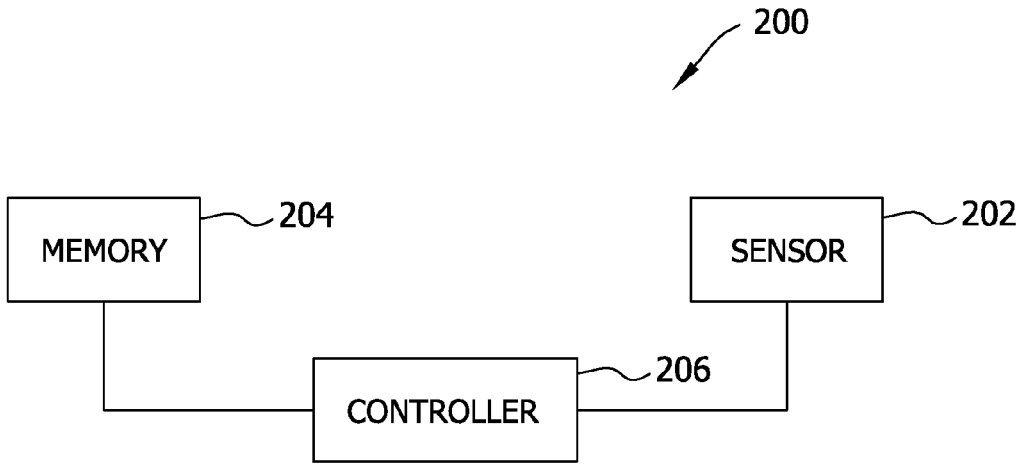
FIG. 2 is a schematic view of an exemplary Remote Sensing Unit (RSU) for use in the system shown in FIG. 1.

FIG. 2 is a schematic view of Remote Sensing Unit (RSU) 102 in a system configuration 200. In the exemplary embodiment, RSU 102 includes an RSU sensor 202, an RSU memory 204, and an RSU controller 206 that communicates with RSU sensor 202, communicates with MAU 104, and/or stores data in RSU memory 204. As used herein, the term controller may include any processor-based or microprocessor-based system, such as a computer system, that includes microcontrollers, reduced instruction set circuits (RISC), application-specific integrated circuits (ASICs), logic circuits, and any other circuit or processor that is capable of executing the functions described herein. The examples provided above are exemplary only, and are not intended to limit in any way the definition and/or meaning of the term controller.

RSU controller 206, in the exemplary embodiment, includes an event counter and/or a time-keeper, such that RSU controller 206 performs real-time counting of sensing events and/or real-time storage of time-stamped sensing events in RSU memory 204 and such that RSU controller 206 transmits to MAU 104, asynchronously from the time at which a presence of a railcar was sensed along Railway R, the counted and/or stored sensing event associated with the sensed presence. As used herein, the term real-time refers to outcomes occurring a substantially short period (i.e., a short amount of time has elapsed) after a change in the inputs affect the outcome, with no intentional delay. As used herein, the term asynchronously means that the time of transmission is not a direct function or result of when the event is sensed, but instead may be carried out at a later time.

In one embodiment, RSU sensor 202 is positioned proximate to entry point 106 and/or exit point 108 of one of railway zones (A, B, C, D, E, and/or F), to enable RSU sensor 202 to detect a presence of an object, such as, for example, a railcar axle and/or a railcar wheel, that enters and/or exits railway zone (A, B, C, D, E, and/or F). In one embodiment, RSU sensor 202 may be an electrical circuit and/or an optical sensor, such as, for example, an infra-red sensor. Alternatively, RSU sensor 202 may be any sensing device that enables RSU 102 to function as described herein. In the exemplary embodiment, RSU 102 transmits signals to MAU 104 and/or receives signals from MAU 104 via RSU controller 206 using any suitable communication device and/or communication medium, such as, for example, a copper cable, a fiber optic cable, a radio frequency or other method of wireless communication, and/or any combination thereof.

In the exemplary embodiment, RSU 102 is solar powered. Alternatively, RSU 102 may be powered using any suitable power source, across any suitable medium, such as hardwiring, for example. In one embodiment, RSU 102 may use and/or may be built into a railway switch machine (not shown) that is positioned proximate to railway R. For example, at least one operation of RSU controller 206 may be performed by an evaluator (not shown) housed within the railway switch machine. In such an embodiment, RSU 102 communicates with MAU 104 using either a communication device and/or a communication medium that is used by a railway switch controller (not shown). In an alternative embodiment, RSU 102 may be an independent unit that is installed separately from the railway switch machine.

Figure 3:
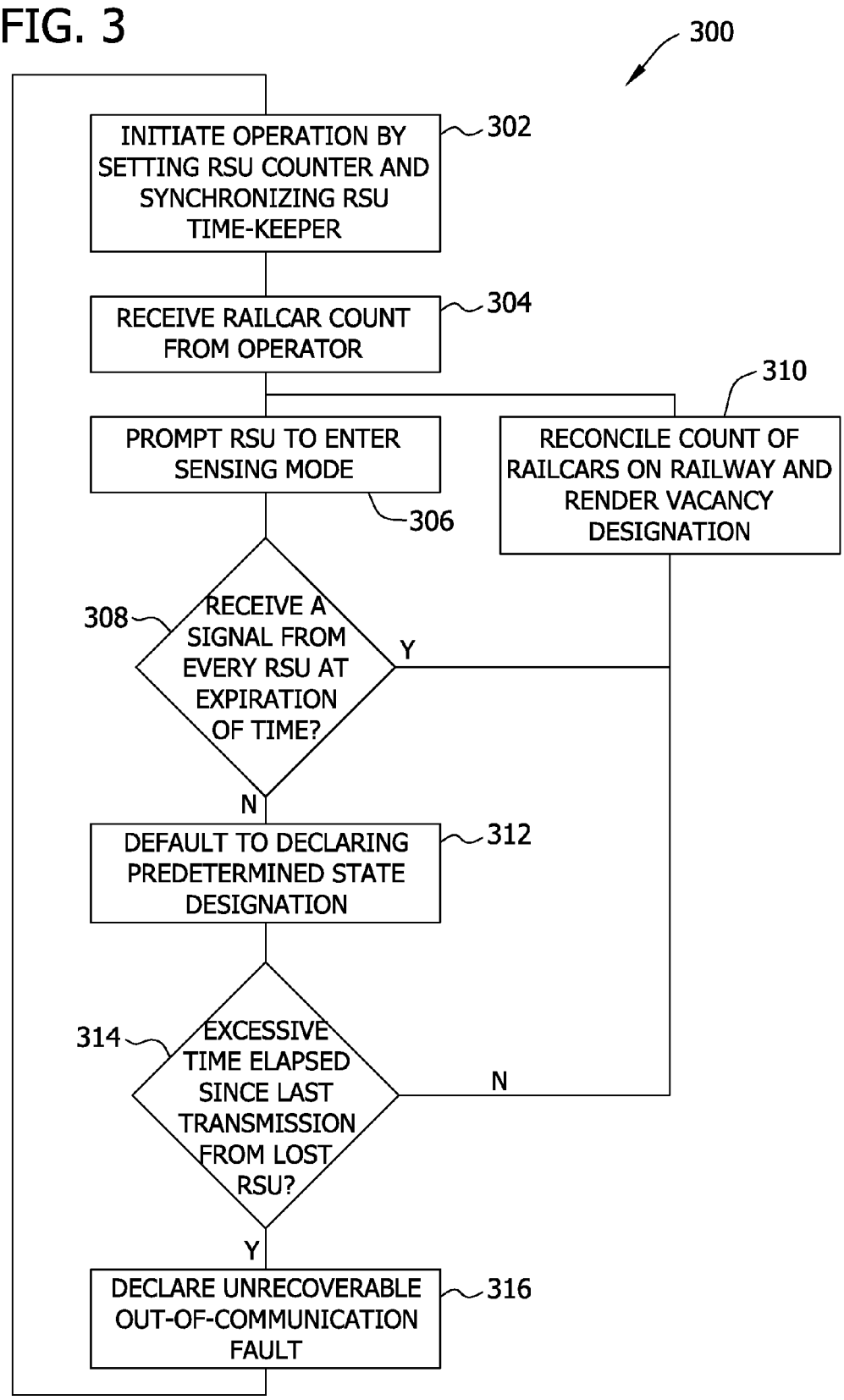
FIG. 3 is a flow diagram of an exemplary method of operation of the Master Accumulation Unit (MAU) shown in FIG. 1.

FIG. 3 is an exemplary vacancy detection operation 300 performed by MAU 104. In the exemplary embodiment, MAU 104 initiates 302 vacancy detection operation 300 by setting the event counter of each RSU 102 to a base value, such as zero, and/or by synchronizing the time-keeper of each RSU 102 with other RSU 102 time-keepers. Alternatively, the event counter and/or time-keeper of RSU 102 may be manually set and/or synchronized either locally and/or remotely by either a railway operator and/or a computer system. After setting and/or synchronizing each RSU 102, a railway operator (not shown), such as, for example, a switch operator and/or a surveillance system, inspects each railway zone (A, B, C, D, E, and/or F) and determines a quantity of railcars present on each railway zone (A, B, C, D, E, and/or F). Such a value is also referred to as the "offset" quantity of railcars. In the exemplary embodiment, the offset quantity of railcars (i.e., a quantity of axles, wheels, and/or any other suitable component of a railcar that may be sensed by RSU sensor 202) is input into MAU 104.

After receiving 304 the offset quantity of railcars, MAU 104 enters into an idle operating mode and prompts 306 each RSU 102 to enter into a sensing mode. In the sensing mode, MAU 104 waits to receive a signal from each RSU 102 that is indicative of a presence of a railcar on railway R. As described in more detail below, after entering into the sensing mode, each RSU 102 transmits, at predetermined time intervals, a signal to MAU 104 indicative of each sensed presence of a railcar on railway zone (A, B, C, D, E, and/or F). Upon receiving 308 a signal from each RSU 102, at the expiration of each time interval, MAU 104 evaluates the received signal from each RSU 102, reconciles 310 a count of railcars present on each railway zone (A, B, C, D, E, and/or F), and renders 310 a designation as to whether each railway zone (A, B, C, D, E, and/or F) is vacant or occupied. In an alternative embodiment, MAU 104 iteratively requests a signal from each RSU 102 at the expiration of each time interval. In the exemplary embodiment, if MAU 104 does not receive 308 a signal from one or more RSU 102 (hereinafter referred to as "a lost RSU") within a predetermined time period, MAU 104 defaults 312 to declaring a predetermined state designation (e.g., an "occupied" state designation) for the specific railway zone (A, B, C, D, E, or F) that was being monitored by the lost RSU 102.

In the exemplary embodiment, if an interruption in communication between MAU 104 and the lost RSU 102 exceeds 314 a predetermined time period, MAU 104 declares 316 an unrecoverable out-of-communication fault in system 100.

Such a declaration 316 causes operation 300 to re-initiate 302 (i.e., reset and re-synchronize each RSU 102). After re-initiating 302 operation 300, each railway R is re-inspected by an operator, and the offset quantity of railcars present on each railway zone (A, B, C, D, E, and F) is re-input into MAU 104 prior to MAU 104 re-prompting 306 each RSU 102 to re-enter the sensing mode. For example, if MAU 104 declares 316 an unrecoverable out-of-communication fault in system 100, a railway operator may inspect railway R and determine that twelve railcars with four axles each, twelve railcars with two axles each, and three railcars with twelve axles each, are present on railway zone A. In such an example, an offset quantity of one hundred and eight axles is input into MAU 104. In the exemplary embodiment, if MAU 104 declares 316 an unrecoverable out-of-communication fault in system 100, MAU 104 maintains the predetermined default state designation (e.g., the "occupied" state designation) for that specific railway zone (A, B, C, D, E, and/or F) that was being monitored by the lost RSU 102 until system operation 300 is re-initiated 302.

If an interruption in communication between MAU 104 and the lost RSU 102 does not exceed 314 the predetermined time period, MAD 104 evaluates the received signal from each RSU 102, including the lost RSU 102, after the communication is reestablished. A count of railcars present on each railway zone (A, B, C, D, E, and/or F) is then reconciled 310, and a designation as to a vacant or an occupied state of each railway zone (A, B, C, D, E, and F) is rendered 310. After rendering 310 a designation as to whether each railway zone (A, B, C, D, E, and F) is vacant or occupied, MAU 104 re-enters the idle mode and re-prompts 306 each RSU 102 to re-enter the sensing mode. As described below, after communication between MAU 104 and the lost RSU 102 has been restored, MAU 104 relies upon historical information that was transmitted to MAU 104 by each RSU 102, including the lost RSU 102, either before and/or after the restoration in communication, to reconcile 310 a count of railcars present on each railway zone (A, B, C, D, E, and/or F).

In one embodiment, after each designation by MAU 104 that a railway zone (A, B, C, D, E and/or F) is vacant, MAU 104 resets either a counter stored within the MAU 104, and/or the counter stored within each RSU 102 that monitors the railway zone (A, B, C, D, E, and/or F) that was designated vacant. Because each RSU counter has a limited storage capacity, RSU 102 may reach a maximum storage capacity if railway zone (A, B, C, D, E, and/or F) has not been declared vacant in a given period of time. If an RSU 102 reaches its maximum counting capacity, the RSU counter automatically rolls-over and begins counting from a base value (e.g., zero). For example, if the RSU counter has a binary storage capacity (e.g., the RSU counter can only store 1024 counts) and if the RSU counter reaches the binary storage capacity limit, the RSU counter automatically rolls over to avoid missing a count. In one embodiment, MAU 104 is programmed to account for the roll-over of the RSU counter when MAU 104 reconciles 310 the count of railcars present on each railway zone (A, B, C, D, E, and/or F).

Figure 4:
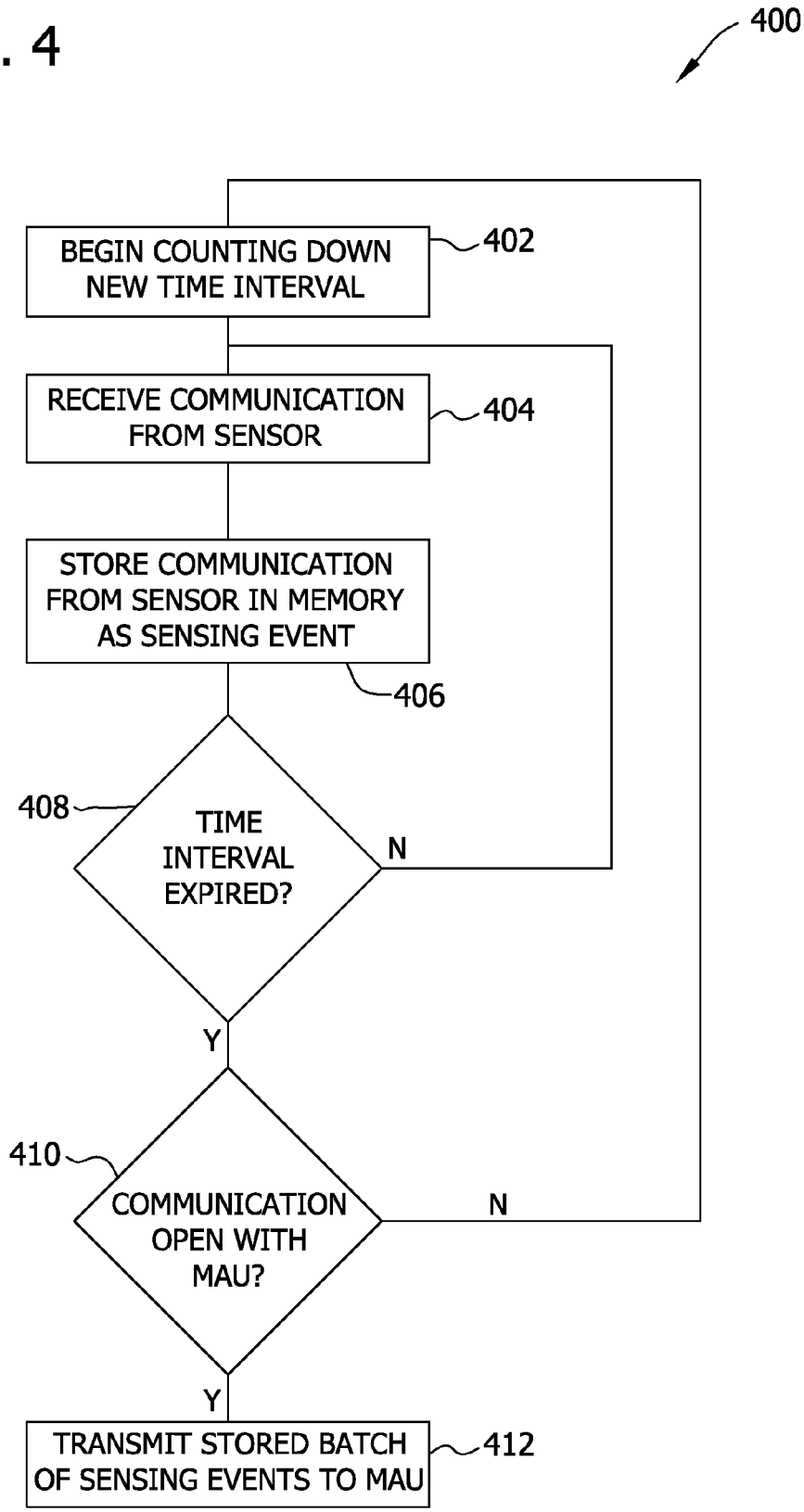
FIG. 4 is a flow diagram of an exemplary method for executing a sensing mode of the Remote Sensing Unit (RSU) shown in FIG. 2.

FIG. 4 is an exemplary sensing mode 400 of RSU 102. As used herein, the term "sensing event" is defined as a sensed presence of an object on railway R. In the exemplary embodiment, the RSU time-keeper initiates sensing mode 400 by counting down 402 a new time interval. As a railcar passes over and/or proximate to RSU sensor 202 and enters railway zone (A, B, C, D, E, and/or F) during the time interval, RSU sensor 202 communicates at least one sensing event to RSU controller 206. RSU controller 206 receives 404 each sensing event transmitted thereto and, in response, increments the RSU counter and/or stores 406 the sensing event in RSU memory 204. In another embodiment, as a railcar passes over, and/or proximate to, RSU sensor 202 and exits railway zone (A, B, C, D, E, or F), RSU sensor 202 communicates a sensing event to RSU controller 206, and RSU controller 206, after receiving 404 the sensing event, decrements the RSU counter and/or stores 406 the sensing event in RSU memory 204. Accordingly, in one embodiment, RSU 102 maintains a running total of railcars that have entered and/or exited each railway zone (A, B, C, D, E, and/or F) during the predetermined time interval. Specifically, to maintain a running total, RSU 102 continuously adds counts to the RSU counter for entering railcars and subtracts counts from the RSU counter for exiting railcars. Alternatively, in response to receiving 404 sensing events from RSU sensor 202, RSU controller 206 increments the RSU counter, and RSU controller 206 attaches a directional indicator to each incremented count, such that RSU 102 maintains a summation of total sensing events.

In the exemplary embodiment, RSU controller 206 time-stamps each sensing event received 404 from RSU sensor 202. RSU controller 206 is programmed to store 406, in RSU memory 204, as a batch of sensing events, every time-stamped sensing event that occurs during a given time interval. As such, RSU 102 maintains a historical record of every time-stamped sensing event that occurred during each expired time interval.

If, after storing 406 each sensing event, RSU controller 206 determines that the predetermined time interval has not expired 408, RSU controller 206 waits to receive 404 another signal from RSU sensor 202. Upon expiration 408 of each time interval, RSU controller 206 searches 410 for an open communication with MAU 104. If an open communication exists, RSU 102 transmits 412 at least one batch of time-stamped sensing events to MAU 104. In one embodiment, RSU controller 206 is also programmed to transmit 412, after each expired time interval, a pre-selected quantity of batches from previously expired time intervals. As such, MAU 104 can maintain a historic record of sensing events for use in reconciling 310, in the event of a communication loss between MAU 104 and RSU 102, the number of railcars that entered and/or exited each railway zone (A, B, C, D, E, and/or F) at any given time prior to, and/or during, the communication loss. If RSU controller 206 searches 410 for an open communication with MAU 104 and determines that the communication has been interrupted, RSU controller 206 re-initiates sensing mode 400.

In the exemplary embodiment, each RSU time-keeper is time synchronized with every other RSU time-keeper, such that each RSU 102 transmits batches of sensing events to MAU 104 at substantially the same time. Alternatively, a first grouping of RSUs 102 that monitors a first railway zone (A, B, C, D, E, or F) is time synchronized to follow a first time interval, and a second grouping of RSUs 102 that monitors a second railway zone (A, B, C, D, E, or F) is time synchronized to follow a second time interval. Accordingly, in such an embodiment, the first grouping of RSUs 102 and the second grouping of RSUs 102 keep time on different intervals and transmit batches of sensing events to MAU 104 at different times, given that the first and second time intervals expire at different times.

As will be appreciated by one skilled in the art and based on the foregoing specification, the above-described embodiments of the operations of the above-described system 100 for detecting railway vacancy may be implemented using computer programming or engineering techniques including computer software, firmware, hardware or any combination or subset thereof that is configured to control various components of a system for detecting railway vacancy. Any resulting program, having computer-readable code means, may be embodied or provided within one or more computer-readable media, thereby making a computer program product, i.e., an article of manufacture, according to the discussed embodiments of the invention. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

The methods and systems described herein facilitate storing sensing events locally, at a remote sensing unit, during an interruption in communication between the remote sensing unit and a master accumulation unit and facilitate transmitting the sensing events stored during the communication interruption to the master accumulation unit upon restoration of communication, thereby adding analysis and communications protocol to facilitate allowing a railway vacancy detection system to reconcile lost communication with a remote sensing unit. The methods and systems described herein also facilitate compensating for errors in timing and data such that a number of remote sensing units is facilitated being expanded in both complexity and distance, thereby facilitating providing cost-effective and reliable railway vacancy detection in virtually any environment.

Exemplary embodiments of methods and systems for detecting railway vacancy are described above in detail. The methods and systems for detecting railway vacancy are not limited to the specific embodiments described herein, but rather, components of the methods and systems may be utilized independently and separately from other components described herein. For example, the methods and systems described herein may have other industrial and/or consumer applications and are not limited to practice with only railway systems as described herein. Rather, the present invention can be implemented and utilized in connection with many other industries.

While the invention has been described in terms of various specific embodiments, those skilled in the art will recognize that the invention can be practiced with modification within the spirit and scope of the claims.

What is claimed is:

1. A method comprising:

sensing, at a remote sensing unit positioned proximate to a pathway, a presence of one or more vehicles traversing the pathway;

storing, in real-time, at the remote sensing unit, one or more sensing events indicative of the sensed presence of the one or more vehicles traversing the pathway and one or more time-stamps of times associated with the one or more sensing events, the one or more sensing events and the one or more time-stamps stored when a communication link between the remote sensing unit and a master accumulation unit is interrupted; and transmitting, asynchronously from the time at which the presence of the one or more vehicles was sensed at the remote sensing unit, a batch of one or more of the sensing events stored at the remote sensing unit and the one or more time-stamps associated with the one or more sensing events to the master accumulation unit when the communication link is opened between the remote sensing unit and the master accumulation unit after the communication link is interrupted.

2. A method in accordance with claim 1, wherein transmitting the batch of the one or more sensing events is performed at predetermined time intervals.

3. A method in accordance with claim 1, wherein storing the one or more sensing events comprises at least one of incrementing a count of a number of the vehicles on the pathway or decrementing the count.

4. A method in accordance with claim 3, wherein storing the one or more sensing events further comprises performing a roll-over of a counter that determines the count of the number of the vehicles upon reaching a designated storage capacity of the counter.

5. A method in accordance with claim 1, further comprising declaring an unrecoverable fault, resetting a counter, and re-synchronizing a time-keeper of the remote sensing unit if the interruption in communication exceeds a predetermined length of time.

6. A method in accordance with claim 1, further comprising declaring the railway as having a predetermined state designation during an interruption in communication between the remote sensing unit and the master accumulation unit.

7. A method in accordance with claim 1, wherein transmitting the one or more sensing events comprises transmitting to the master accumulation unit, after communication has been restored, the one or more sensing events that were stored at the remote sensing unit during an interruption in the communication link between the remote sensing unit and the master accumulation unit.

8. A method in accordance with claim 7, further comprising:

receiving, at the master accumulation unit, the one or more sensing events that were stored at the remote sensing unit during the interruption in the communication link;

reconciling, using the master accumulation unit, a quantity of vehicles present on the pathway after the communication link between the remote sensing unit and the master accumulation unit has been restored; and rendering a designation as to a vacant or occupied state of the pathway based on the quantity of vehicles.

9. A method in accordance with claim 1, wherein the one or more vehicles include at least one rail vehicle and the pathway includes a railway.

10. A method in accordance with claim 1, further comprising receiving an offset quantity of vehicles that are already present on the pathway when the presence of the one or more vehicles is sensed at the remote sensing unit and determining whether the pathway is occupied by at least a designated number of the vehicles based on the offset quantity and the one or more sensing events.

11. A method in accordance with claim 1, further comprising designating the pathway as occupied by at least a designated number of the vehicles when a time duration of an interruption in communication between the remote sensing unit and the master accumulation unit exceeds a designated threshold, regardless of an actual number of the vehicles on the pathway.

12. A method in accordance with claim 1, further comprising designating the pathway as occupied or vacant based on a count of the one or more sensing events and, once the pathway is designated as occupied or vacant, re-setting the count of the one or more sensing events.

13. A method in accordance with claim 1, wherein the one or more sensed events include a direction of travel of the one or more vehicles moving by the remote sensing unit, and further comprising determining a number of the vehicles on the pathway based on the direction of travel of the one or more vehicles.

14. A system comprising:

a master accumulation unit; and a remote sensing unit in communication with said master accumulation unit, said remote sensing unit positioned proximate to a pathway, said remote sensing unit configured to:

sense a presence of one or more vehicles traversing the pathway;

store, in real-time, at said remote sensing unit, one or more sensing events indicative of a sensed presence of the one or more vehicles traversing the pathway and one or more time-stamps indicative of when the one or more sensing events are sensed, the remote sensing unit configured to store the one or more sensing events and the one or more time-stamps when a communication link between the remote sensing unit and the master accumulation unit is interrupted; and transmit, asynchronously from the time at which the presence of the one or more vehicles was sensed, a batch of the one or more sensing events that were stored and the one or more time-stamps to said master accumulation unit when the communication link between the remote sensing unit and the master accumulation unit is opened after being interrupted.

15. A system in accordance with claim 14, wherein said remote sensing unit is configured to transmit the one or more sensing events to said master accumulation unit at predetermined time intervals.

16. A system in accordance with claim 14, wherein said remote sensing unit is configured to at least one of increment or decrement a counter in response to the sensed presence of a the one or more vehicles traversing the pathway.

17. A system in accordance with claim 16, wherein said remote sensing unit is configured to roll-over of said counter upon reaching a designated storage capacity of said counter.

18. A system in accordance with claim 14, wherein said remote sensing unit is further configured to declare an unrecoverable fault, reset a counter, and re-synchronize a timekeeper if the communication link is interrupted for longer than a predetermined length of time.

19. A system in accordance with claim 14, wherein said master accumulation unit is configured to declare the pathway as having a predetermined state designation during interruption of the communication link.

20. A system in accordance with claim 14, wherein said remote sensing unit is further configured to transmit to said master accumulation unit, after the communication link has been restored, at least one of the one or more sensing events that was stored at said remote sensing unit during the interruption of the communication link.

21. A system in accordance with claim 20, wherein said master accumulation unit is configured to:

receive the at least one of the one or more sensing events that was stored in said remote sensing unit during the interruption of the communication link;

reconcile a quantity of the vehicles present on the pathway after the communication link has been restored by evaluating the at least one of the one or more sensing events that was stored in said remote sensing unit during the interruption in the communication link; and render a designation as to a vacant or occupied state of the pathway based on the at least one of the one or more sensing events that was stored in said remote sensing unit during the interruption in the communication link.

22. A system in accordance with claim 14, wherein the one or more vehicles includes a rail vehicle and the pathway includes a railway.

23. A system in accordance with claim 14, wherein the master accumulation unit is configured to receive an offset quantity of vehicles that are already present on the pathway when the presence of the one or more vehicles is sensed at the remote sensing unit, the master accumulation unit further configured to determining whether the pathway is occupied by at least a designated number of the vehicles based on the offset quantity and the one or more sensing events.

24. A system in accordance with claim 14, wherein the master accumulation unit is configured to designate the pathway as occupied by at least a designated number of the vehicles when a time duration of an interruption in communication between the remote sensing unit and the master accumulation unit exceeds a designated threshold, regardless of an actual number of the vehicles on the pathway.

25. A system in accordance with claim 14, wherein the master accumulation unit is configured to designate the pathway as occupied or vacant based on a count of the one or more sensing events and, once the pathway is designated as occupied or vacant, the master accumulation unit is configured to re-set the count of the one or more sensing events.

26. A system in accordance with claim 14, wherein the one or more sensed events include a direction of travel of the one or more vehicles moving by the remote sensing unit, and wherein the master accumulation unit is configured to determine a number of the vehicles on the pathway based on the direction of travel of the one or more vehicles.

27. A method comprising:

receiving, at a master accumulation unit asynchronously from a time at which a presence of a vehicle was sensed by a remote sensing unit, a sensing event indicative of the sensed presence of the vehicle traversing a pathway and a time-stamp representative of when the sensing event is sensed, the sensing event sensed by the remote sensing unit during an interruption of a communication link between the remote sensing unit and the master accumulation unit, wherein the sensing event and the time-stamp are received by the master accumulation unit after the communication link is restored; and rendering a designation as to a vacant or occupied state of the pathway based on the sensing event and the time-stamp.

28. A method in accordance with claim 27, a quantity of vehicles present on the pathway based on the sensing event.

29. A method in accordance with claim 27, wherein the one or more vehicles includes a rail vehicle and the pathway includes a railway.

30. A method in accordance with claim 27, further comprising receiving an offset quantity of vehicles that are already present on the pathway when the presence of the one or more vehicles is sensed at the remote sensing unit, wherein rendering the designation includes determining whether the pathway is occupied by at least a designated number of the vehicles based on the offset quantity and the one or more sensing events.

31. A method in accordance with claim 27, wherein rendering the designation includes designating the pathway as occupied by at least a designated number of the vehicles when a time duration of an interruption in communication between the remote sensing unit and the master accumulation unit exceeds a designated threshold, regardless of an actual number of the vehicles on the pathway.

32. A method in accordance with claim 27, wherein rendering the designation includes designating the pathway as occupied or vacant based on a count of the one or more sensing events and, once the pathway is designated as occupied or vacant, re-setting the count of the one or more sensing events.

33. A method in accordance with claim 27, wherein the one or more sensed events include a direction of travel of the one or more vehicles moving by the remote sensing unit, and wherein rendering the designation includes determining a number of the vehicles on the pathway based on the direction of travel of the one or more vehicles.

* * * * *

UNITED STATES PATENT AND TRADEMARK OFFICE

CERTIFICATE OF CORRECTION

PATENT NO. : 8,452,466 B2
APPLICATION NO. : 12/116792
DATED : May 28, 2013
INVENTOR(S) : Kiss et al.

It is certified that error appears in the above-identified patent and that said Letters Patent is hereby corrected as shown below:

In the Specification

Column 5, Line 23, delete "MAD 104" and insert -- MAU 104 --, therefor.

In the Claims

Column 9, Line 35, in Claim 16, delete "a the" and insert -- the --, therefor.

Column 10, Line 9, in Claim 23, delete "to determining" and insert -- to determine --, therefor.

Column 10, Line 46, in Claim 28, after "claim 27,", insert -- further comprising reconciling --.

Signed and Sealed this
Twenty-fifth Day of March, 2014

Michelle K. Lee

Michelle K. Lee
*Deputy Director of the United States Patent and Trademark Office*